US006149698A

United States Patent [19]

Uehara

[11] Patent Number: 6,149,698

[45] Date of Patent: Nov. 21, 2000

[54] APPARATUS FOR INSTALLING A VENTILATION FAN

[76] Inventor: Kiyomasa Uehara, 6-1 Kyohara, Naha-shi, Okinawa, Japan

[21] Appl. No.: 08/729,696

[22] Filed: Oct. 7, 1996

[51] Int. Cl.[7] ..... B01D 59/50

[52] U.S. Cl. ..... 55/385.1; 55/481; 55/506; 55/385.7; 55/473; 55/467; 454/351; 454/353

[58] Field of Search ..... 454/351, 353; 55/471, 501, 511, 473, 467, 506, 481, 385.1, 385.2, 385.7, 482

[56] References Cited

U.S. PATENT DOCUMENTS

| | | | |
|---|---|---|---|
| 1,189,572 | 7/1916 | Ilg | 454/351 |
| 1,924,489 | 8/1933 | Ferris | 454/351 |
| 2,687,687 | 8/1954 | Prudhon | 454/351 |
| 4,759,196 | 7/1988 | Davis | 55/471 |
| 4,781,526 | 11/1988 | Mead | 55/501 |

FOREIGN PATENT DOCUMENTS 6-323585 11/1994 Japan .

*Primary Examiner*—Jay H. Woo
*Assistant Examiner*—Robert Hopkins
*Attorney, Agent, or Firm*—Arthur P. Gershman

[57] ABSTRACT

An apparatus, for installing a ventilation fan, highly effective for preventing dust, gas or the like from coming in a room has been provided by the present invention. An apparatus 1 for installing a ventilation fan comprises a L-shaped housing 5, for fixing a ventilation fan 3 therein, having an inside opening 7 positioned inside a wall W, and an outside opening which looks down and is positioned outside the wall W. The inside opening 7 is provided with a filter 11 for exhaust able to be slide vertically, and able to be taken in and out from the housing 5. Further, the inside opening 7 is covered with a metallic lid 13 able to be open or shut. A filter 15 for absorbed air is provided near the outside opening 9. The filter 15 is able to slide horizontally. The ventilation fan F is rotatable clockwise and counterclockwise. The filter 15 for absorbed is installed in absorbing air. The filter 11 for exhaust is installed in exhausting air. The filter 11 comprises a cassette filter 11*c*, and the filter 15 for absorbed air comprises a cassette filter 15*c*. The cassette filters 11*c* and 15*c* can be exchanged depending on their use.

8 Claims, 5 Drawing Sheets

APPARATUS FOR INSTALLING A VENTILATION FAN

BACKGROUND OF THE INVENTION

1. Field of the Invention

The present invention relates to an apparatus for installing a ventilation fan, especially in a hole bored through a wall of a building and the like.

2. Description of the Prior Art

The present inventor has already proposed in Japanese Laid-Open Patent Publication No. 6-323585, whose patent has been allowed as Japanese Patent No. 2530284, an apparatus for installing a ventilation fan highly effective in attaining crime prevention and antidisaster. This apparatus is applied especially for installing a ventilation fan in a hole bored through a wall of a building and comprises a housing, for fixing a ventilation fan therein, having at a building side an opening covered with a lid able to be open or shut.

The apparatus is now expected to be used under many different environments. Depending on the place where a building provided with the apparatus is located, it is possible that dust outside the building, air pollutant such as nitrogen oxide, poisonous gas and etc. pass through the ventilation fan and come into a room of the building, e.g., located along a road, in a factory zone, a dangerous area or the like.

The object of the present invention is to improve the apparatus in prevention of dust, gas or the like from coming into the building.

SUMMARY OF THE INVENTION

The present invention provides an apparatus, for installing a ventilation fan in a hole bored through a wall of a building and the like, which comprises a L-shaped housing, for fixing a ventilation fan therein, an inside opening of the housing positioned inside the wall, an outside opening of the housing which looks down and is positioned outside the wall, and a filter able to be attached to or detached from one of said inside and outside openings.

In the present invention, dust, gas or the like in the outside is effectively prevented from coming into the building or the like by covering the inside or outside opening with the filter.

DETAILED DESCRIPTION OF THE PREFERRED EMBODIMENTS

With reference to the drawings, a first embodiment of the present invention is explained below.

Figure 1:
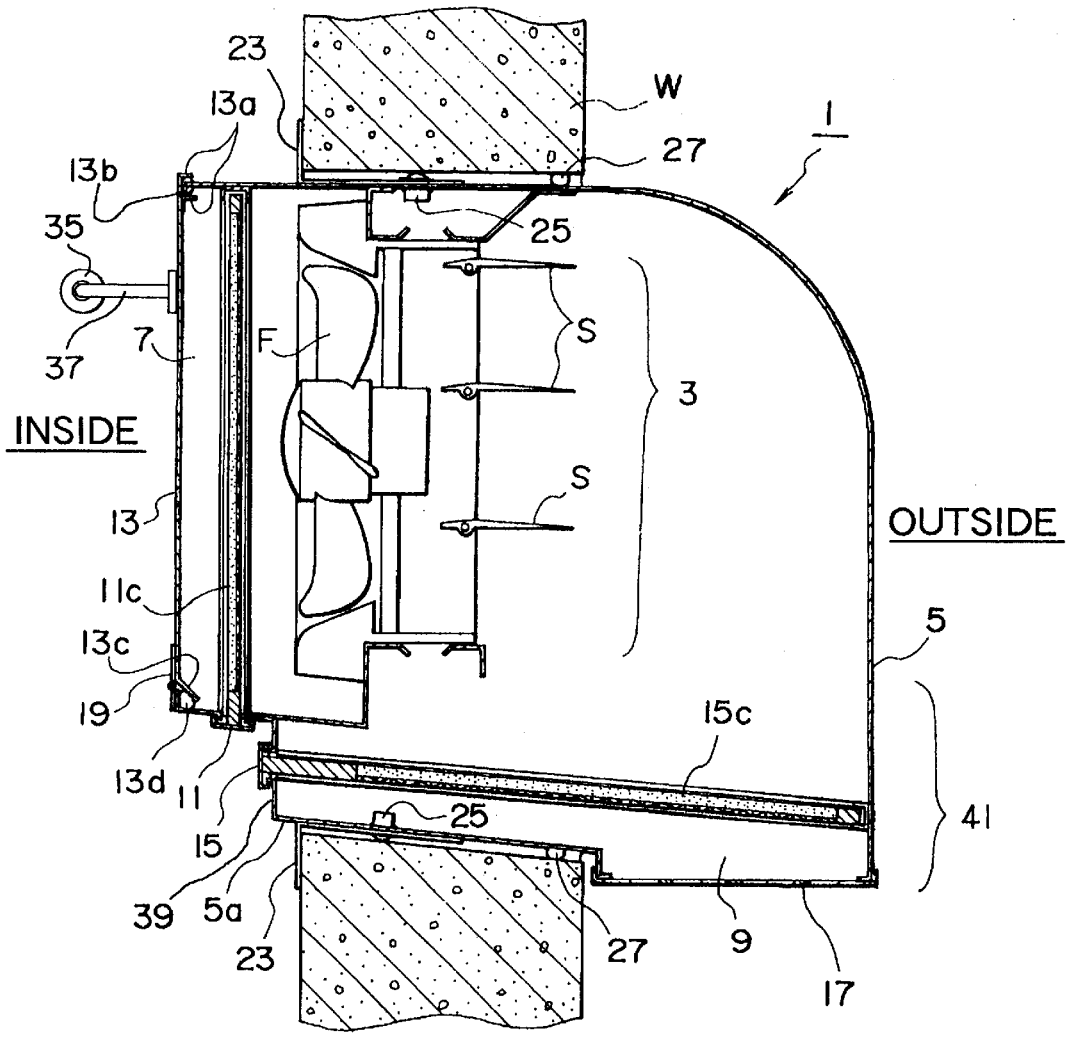
FIG. 1 is a sectional view showing an apparatus for installing a ventilation fan of the present invention installed in a hole bored through a wall of a building.
Figure 2:
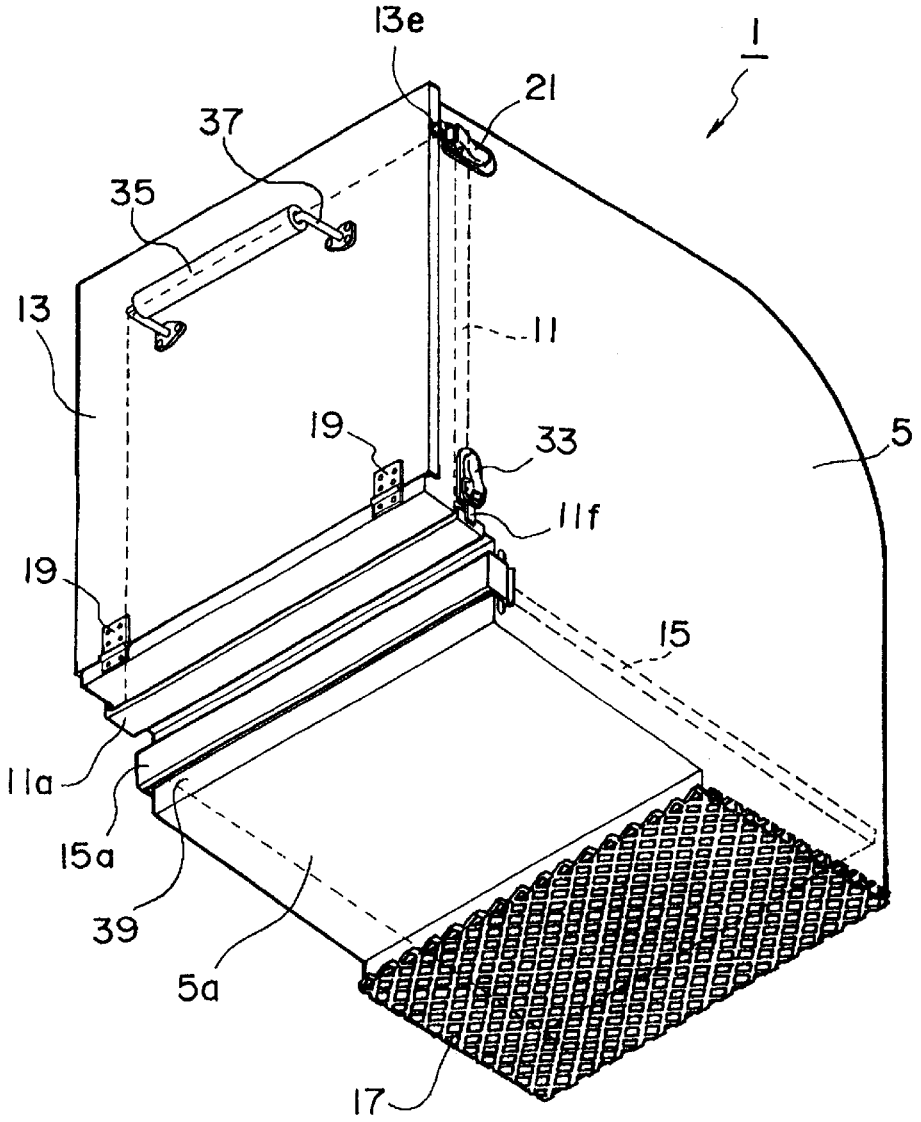
FIG. 2 is a perspective view showing the whole apparatus of FIG. 1.

FIG. 1 shows a sectional view of the apparatus 1 for installing a ventilation fan of the present invention installed in a hole bored through a wall W of a building. FIG. 2 shows a perspective view of the whole apparatus 1. As shown in these figures, the apparatus 1 comprises a L-shaped metallic housing 5 for fixing a ventilation fan 3 therein. The housing 5 has an inside opening 7 inside the wall W (See the left side of FIG. 1) and an outside opening 9, which looks down, outside the wall W (See the right side of FIG. 1). The outside opening 9 is positioned at the end of a vertical portion of the housing 9. As shown in FIG. 1, a side face 39 of the vertical portion 41 of the housing 5 is positioned inside the wall W. The ventilation fan 3 is generally found on the market and comprises fan F, Shutter S, switch not shown in the figures, and etc.

The inside opening 7 is provided with a filter 11 for exhaust. The filter 11 is able to slide vertically, i.e., upwardly and downwardly in FIG. 1, through a slit provided at the bottom of the housing 5 and able to be taken in and out from the housing 5. Further, the inside opening 7 is covered with a metallic lid 13. The lid can be open or closed freely by operation. In the housing 5 close to the outside opening 9, a filter 15 for absorbed air is installed. The filter 15 is able to slide horizontally, i.e., toward right and left direction in FIG. 1 through a slit 31 (shown in FIG. 3) provided at one side of the housing 5, and able to be taken in and out from the housing 5. The outside opening 9 is covered with a metallic net 17. The ventilation fan 3 is rotatable clockwise and counterclockwise. The filter 15 is attached to the housing 5 in absorbing air, and the filter 11 is attached to the housing 5 in exhausting air.

As shown in FIG. 1, a bottom plate 5*a* of the housing 5 inclines to outside from the inside of the building as becoming low enough to drain rain water and the like outside easily.

The lid 13 is attached to the housing 5 by a hinge 19 and can be open or shut by handling a handle 35. The handle 35 has a shape of cylinder and is held rotatably by a spindle 37. The spindle 37 is fixed to the lid 13 by welding, using a screw or the like. The lid 13 is rectangular and provided with two projected frames 13*a*, 13*a* along a periphery thereof except its bottom side so as to form a groove between the frames 13*a*, 13*a*. A bottom of the groove is provided with a rubber packing 13*b*. On a bottom side of the lid 13, a bend 13*c* is formed. The bend 13*c* is bent at more than right angle so as to incline slightly toward the outside of the lid 13. On the lid 13, outside the bend 13*c*, between the bottom edge of the lid 13 and the bend 13*c*, a rubber packing 13*d* is adhered. In shutting the lid 13, the edge of the top plate and side plates constituting the housing 5 is fitted in the groove formed along the periphery of the lid 13 and closely contacted to the rubber packing 13*b*. At the same time, the bend 13*c* seals the connecting portion, which includes the hinge 19, of the lid 13 and the housing 5 and contacts closely inside the housing 5 through the rubber packing 13*d*. Thus, the lid 13 prevents entrance of rain, wind, or thieves.

As shown in FIG. 2, the lid 13 is provided with a hook 13*e* on the top side thereof. A fastener 21 is installed on the housing 5 and can lock the hook 13*e*. The lid 13 can be easily locked with the fastener 21.

As shown in FIG. 1, a metallic plate 23 for installing the apparatus 1 is fixed to the housing 5 by a bolt 25. The metallic plate 23 is also fixed to the wall W by using normal bolts, anchor bolts or the like. Between the housing 5 and the wall W, a rubber packing 27 is interlaid.

Figure 3:
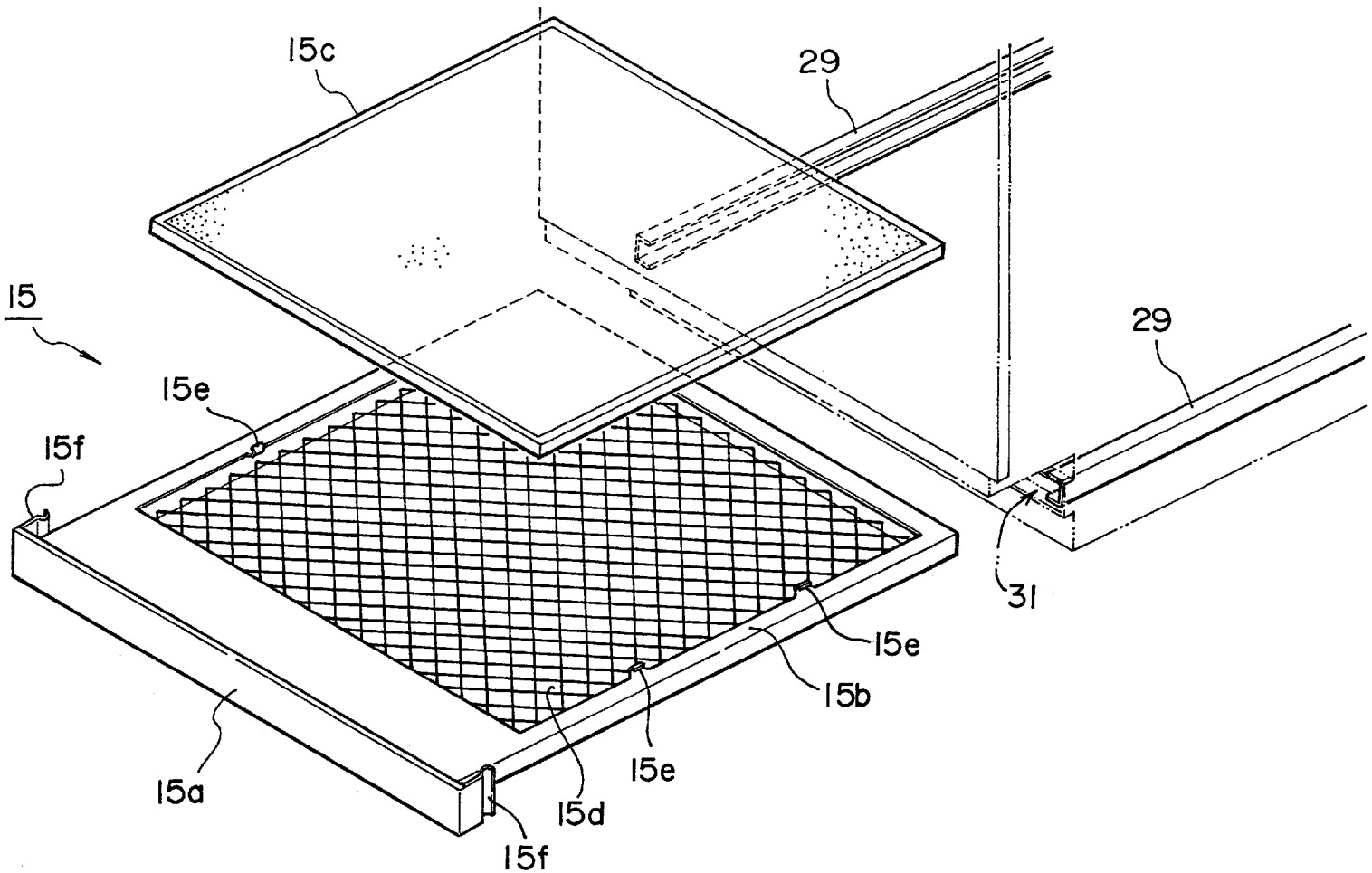
FIG. 3 is an exploded view showing the detail of a filter for absorbed air.

FIG. 3 is an exploded view showing the detail of the filter 15. The filter 15 is in the form of a cassette and consists of a handle 15*a*, a frame 15*b* having an opening, a cassette filter (a filter element) 15*c* to be installed in the opening and a net 15*d* stretched over the opening of the frame 15*b*. On the opening side of the frame 15*b*, four picks 15*e* for holding the filter element 15*c* are provided. In fitting the cassette filter 15*c* in the opening of the frame 15*b*, the picks 15*e* hold the back side of the cassette filter 15*c* to fix the cassette filter 15*c* tightly in the opening. A structure of a cassette filter is not restricted to the above embodiment since a filter element can be mounted on the frame in many ways by using known methods.

The cassette filter 15*c* can be exchanged as occasion calls. The cassette filter 15*c* is selected for screening dust, air pollutant, poisonous gas or the like depending on the surrounding in which the apparatus 1 is set.

As shown in FIG. 3, the frame 15*b* is put into frame holders 29, 29 provided at the bottom side of the housing 5. The frame holder 29 has a groove in which the frame 15*b* is put. After pressing horizontally and putting completely the filter 15 into the frame holder 29, a spring 15*f*, provided at the both ends of the handle 15*a*, is hung on a holder not shown in the figures to fix the filter 15. Because a slit 31 for taking the frame 15*b* in and out is provided on the side face 39 (FIG. 1) of the vertical portion 41 of the housing 5, positioned inside the wall W, the filter 15, which covers the outside opening 9, can easily be taken in and out or exchanged while staying inside the building.

The filter 11 for exhaust has essentially the same construction with the filter 15 for absorbed air except that a hook 11*f* is provided at both ends of the handle 11*a* of the filter 11 for exhaust as shown in FIG. 2. At the side of the housing 5, a fastener 33 for tightening is provided. The fastener 33 for tightening can tighten the hook 11*f* to fix the filter 11 so as not to drop the filter 11.

The apparatus 1 such a constitution as explained above. In exhausting air, the lid 13 is opened and the filter 11 for exhaust is put in the housing 5. The filter 11 is fixed by the fastener 33 for tightening. In this case, the cassette filter 15*c* is taken out from the filter 15 and only the frame 15*b* for installing a filter is inserted in the frame holder 29, thereby a flow of exhausted air is improved and dust is prevented from collecting in a groove of the frame holder 29. When the ventilation fan F is rotated in this state, air in a room of the building passes through the cassette filter 11*c* and is exhausted outside the room from the outside opening 9. Supposing that outside air could come into the room through the housing 5, dust, pollutant or the like is screened by the filter 11*c*. Of course, in the case when air in the room is soiled, dust, pollutant or the like in the air inside the room is screened by the filter 11*c* and clean air is exhausted outside.

On the other hand, in absorbing air, the filter 15 for absorbed air is put in the housing 5, the cassette filter 11*c* is taken out from the filter 11 and only the frame for installing a filter is inserted in the housing 5. Dust, pollutant, poisonous gas or the like is screened by this.

Both filter elements 11*c* and 15*c* may be removed from the filters 11 and 15, respectively, while filter frames are kept inserted. Even in this case, the lid 13 is effective for security and antidisaster.

Figure 4:
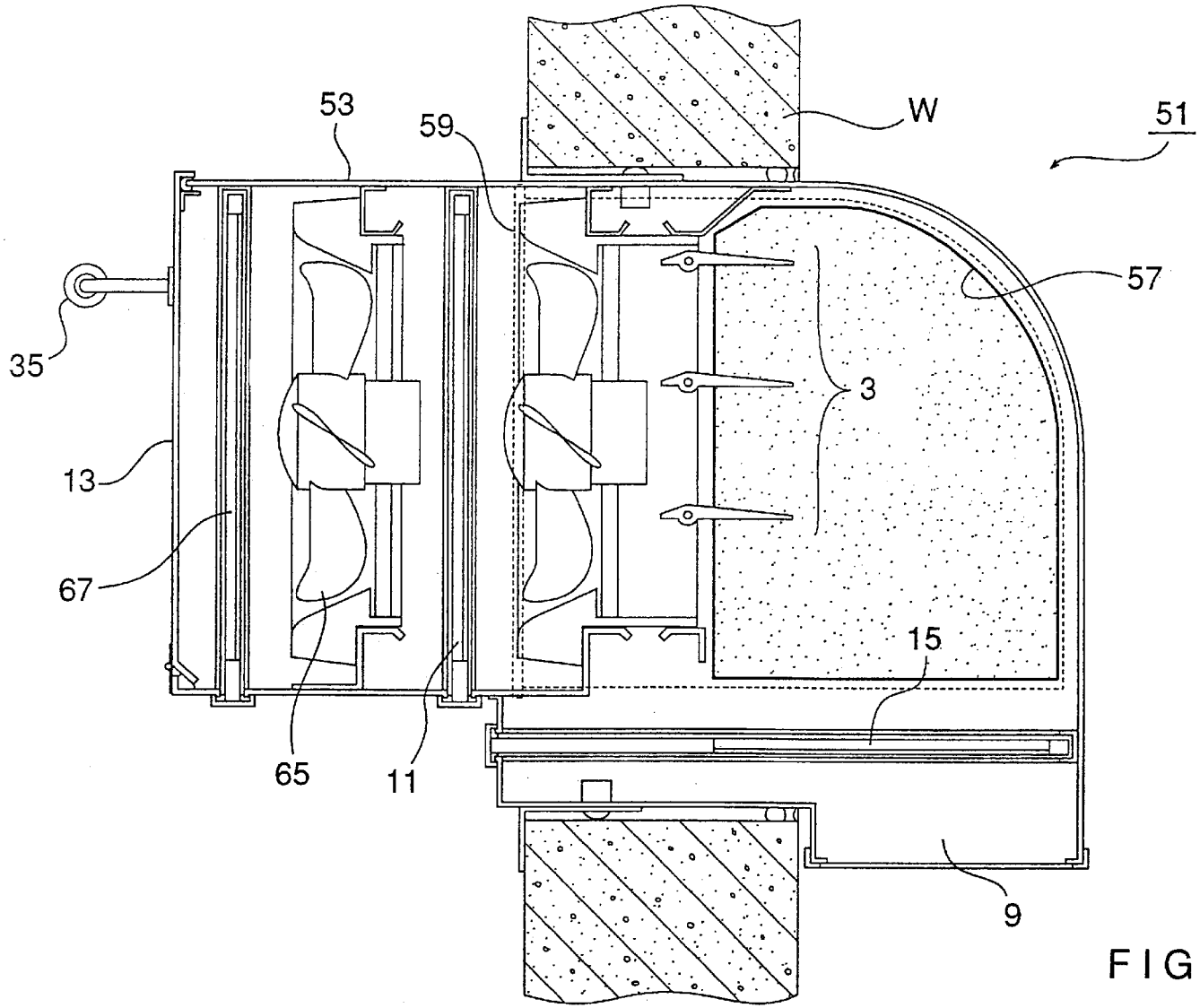
FIG. 4 is a sectional view of a second embodiment of the present invention.
Figure 5:
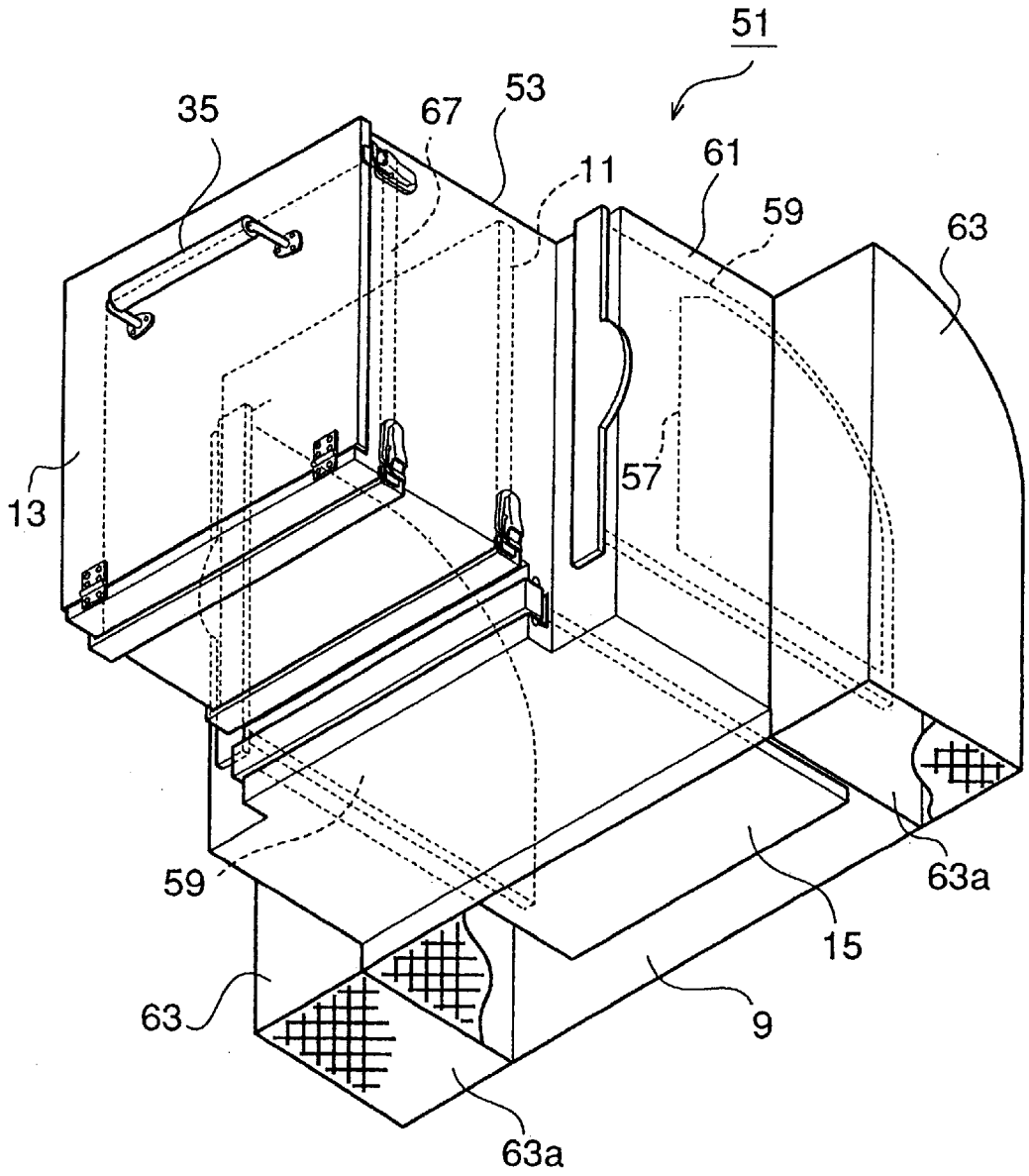
FIG. 5 is a perspective view of the second embodiment.

A second embodiment of the present invention will be explained referring to FIGS. 4 and 5. The apparatus 51 is provided with the outside opening 9 and, in addition, side face openings 57, 57 on side faces of the housing 53, thus increasing ventilation ability. Further, by adding filters 59, 59 covering the openings 57, 57, filtering ability will be highly increased.

On both sides of the housing 53, filters 59, 59 to cover the openings 57, 57 are provided and are slidable in filter holders 61, 61. The side face openings 57, 57 are covered by hoods 63, 63 which are fixed on the housing 53 by welding, using screws or the like. Each hood 63 has opening 63*a* directed downward and prevents entrance of rain and wind from the side face opening 57. Inside air is exhausted downward from opening 63*a* and outside air is introduced inside from opening 63*a* though the side opening 57.

A structure of filter 59 is essentially the same as one shown in FIG. 3. That is, the filter 59 is in the form of cassette and a filter element is installed in a filter frame and can be exchanged depending on its application. The filter element is installed so as to cover the side opening 57. The filter 59 may be locked in the holder 61 by using, for example, a spring like the spring 5*f* shown in FIG. 3.

In an inside opening of the housing 53, a filter 11 (the same as the filter 11 in FIGS. 1 and 2) is inserted vertically. Next to the filter 11, a fan 65 and a filter 67 are arranged in this order. A structure of filter 67 is essentially the same as the filter 11 in FIGS. 1 and 2. Further additional fans and filters may be installed if necessary. A lid 13 is attached to the apparatus 51. The lid can be open and closed by using a handle 35.

In exhausting air, the lid 13 is opened and the filters 11, 67 are put in the housing 5. In this case, filter elements are taken out from the filters 15, 59 and only the frames for installing filter elements are inserted in the housing 53, thereby a flow of exhausted air is improved and dust is prevented from collecting in a groove of frame holders. When the ventilation fans 3, 65 are rotated in this state, air in a room of the building passes through the filters 67, 11 and is exhausted outside the room from the outside opening 9 and side face openings 57, 57. Side face openings 57, 57 make it possible to reduce the resistance of ventilation. In addition, since two fans 3, 65 are installed, ventilation ability is highly increased.

On the other hand, in absorbing air, the filters 15, 59 are put in the housing 53, the filter elements are removed from the filters 11, 67 and only the filter frames are inserted in the housing 53.

The embodiment of the present invention has been described above. However, the present invention is not restricted to the above embodiment, since the present invention can be modified in many ways and has many applications. For example, the apparatus of the present invention can be applied to all of the rooms which commonly require to be ventilated and therefore includes rooms of not only a building but also ship, airplane, rolling stock and etc. The housings 5, 53 may have a cylindrical opening in place of the rectangular opening as explained in the above embodiment. Further, the apparatus of the present invention may be provided with one of the filters 11 and 15 depending on its application.

In place of filters described above, a flat plate may be inserted in the slit of housings 5, 53 so that such flat plate is used to shut the opening of the housings 5, 53. In this case, the lid 13 can be omitted to reduce costs for manufacturing the apparatus 1, 51.

Such a cassette filter as explained above can be applied not only to a ventilator but also to other apparatuses which require absorbing or exhausting air such as an air conditioner and etc.

In previous ventilation fans, air conditioners and the like, filter and frame thereof are stuck to each other or unified together. Accordingly, exchanging a filter depending on its application was impossible previously. Further, there was no idea of changing a filter depending on its application. A cassette filter having essentially the same constitution with those found in the above embodiment enables to exchange a filter depending on its application. For example, a filter applied for screening dust, pollutant, poisonous gas or the like can be exchanged easily to another filter in accordance with surroundings in which a ventilation fan, an air conditioner or the like is set.

As explained above, the present invention enables to provide an apparatus for installing a ventilation fan highly effective in preventing dust, gas or the like and in attaining crime prevention and antidiaster.

What is claimed is:

1. An apparatus for installing a ventilation fan in a hole bored through a vertical wall of a room, comprising:

an L-shaped housing having both inner and outer openings for fixing the ventilation fan therein;

filter mounting openings in the L-shaped housing extending both inside the wall in the generally vertical plane and outside the wall in the generally horizontal plane; and filter media able to be attached to or detached from each of said inside and outside openings.

2. The apparatus of claim 1, wherein said filter media comprises a frame and a filter element for being installed exchangeably in the frame.

3. The apparatus of claim 1, wherein a slit is provided inside the wall of the room wherein said filter media installed in said outside opening is removable from inside said room.

4. The apparatus of claim 1, wherein the apparatus has a slit inside the wall for taking therein and out therefrom said filter installed in said outside opening.

5. The apparatus of claim 1, further comprising:

a side face opening of said housing which is positioned outside the wall; and a filter able to be attached to or detached from one of said inside and side face openings.

6. The apparatus of claim 5, wherein said filter comprises a frame and a filter element for being installed exchangeably in the frame.

7. The apparatus of claim 5, wherein the apparatus has a slit inside the wall for taking therein and out therefrom said filter installed in said side face opening.

8. The apparatus of claim 6, wherein the apparatus has a slit inside the wall for taking therein and out therefrom said filter installed in said side face opening.

* * * * *